United States Patent [19]

Vesa et al.

[11] Patent Number: 4,843,685

[45] Date of Patent: Jul. 4, 1989

[54] CARD

[75] Inventors: Juha Vesa; Jorma Nieminen, both of Turku, Finland

[73] Assignee: Kevytrakenne Oy, Piispanristi, Finland

[21] Appl. No.: 233,959

[22] Filed: Aug. 18, 1988

Related U.S. Application Data

[63] Continuation of Ser. No. 85,291, Aug. 10, 1987, abandoned, which is a continuation of Ser. No. 825,462, Nov. 27, 1985, abandoned.

[30] Foreign Application Priority Data

Apr. 3, 1984 [FI] Finland ..... 841334

[51] Int. Cl.[4] ..... D01G 15/02

[52] U.S. Cl. ..... 19/98; 19/101; 19/106 R; 19/296

[58] Field of Search ..... 19/98, 99, 100, 101, 19/106 R, 296

[56] References Cited

U.S. PATENT DOCUMENTS

| | | | |
|---|---|---|---|
| 4,523,350 | 6/1985 | Schmiedgen et al. | 19/98 |
| 4,712,276 | 12/1987 | Krusche | 19/99 |
| 4,723,343 | 2/1988 | Bernhardt et al. | 19/98 |

*Primary Examiner*—Louis K. Rimrodt

*Attorney, Agent, or Firm*—Kenyon & Kenyon

[57] ABSTRACT

The invention relates to a card for the production of a nonwoven fabric web. The object is to provide a new card enabling a high production rate and the manufacturing to be interrupted without any breaks in the web itself. The card comprises e.g. three main rolls (12, 17, 20), whereby slower transfer rolls (15, 16; 18, 19) acting as working rolls as well are provided between said main rolls. At least one flatting roll (23) is provided after the last main roll (20), from which roll (23) the fibers are advantageously transferred onto a conveyor wire (29) by means of an aspiration roller (28), said wire passing the fiber material web to further treatment.

2 Claims, 3 Drawing Sheets

CARD

This application is a continuation, of application Ser. No. 085,291, filed Aug. 10, 1987, now abandoned which is a continuation of Ser. No. 825,462 filed Nov. 27, 1985, now abandoned.

The present invention relates to a card for the production of a nonwoven fabric or gauze web. The finished product is used e.g. for nappies.

Known cards for said purpose comprise a large, rotating roll called a main roll, on the surface of which the fiber material, pretreated to some extent, is fed and along the circumference of which a large number of so called working rolls are positioned. The fiber material is passed round said working rolls and is simultaneously treated so that the fibers after the last working roll are essentially oriented in the longitudinal direction of the web. A collector roll which rotates at a lower rate and is positioned after the main roll collects the fibers on the surface thereof, wherefrom the fiber web is passed on a conveyor and further to a heat treatment.

One disadvantage of known cards is that the fibers in a finished web are excessively oriented in the longitudinal direction of the web, whereby the breaking strength is poor in the other directions. When the manufacture for some reason or other must be interrupted, the main roll continues to rotate for a long time because of the large mass thereof, whereby waste product is obtained, firstly, when the main roll is gradually emptied and, secondly, after re-starting when the main roll is gradually filled up. Besides, the production rate is determined on the basis of the treating capacity of the working roll positioned at the beginning of the circumference of the main roll, which capacity is relatively low.

The object is to provide a new card, which eliminates the afore-mentioned disadvantages.

The card according to the invention is mainly characterized in that it comprises at least two main rolls, that transfer rolls rotating at a lower rate are positioned between said main rolls, said transfer rolls simultaneously acting as working rolls, and that at least one flatting roll rotating at a lower rate and that means for passing the fiber web to further treatment are positioned after the last main roll.

Preferred embodiments of the card are more closely defined in claims 2 to 8; they also appear from the following detailed description, wherein the attached drawing is referred to.

Figure 1:
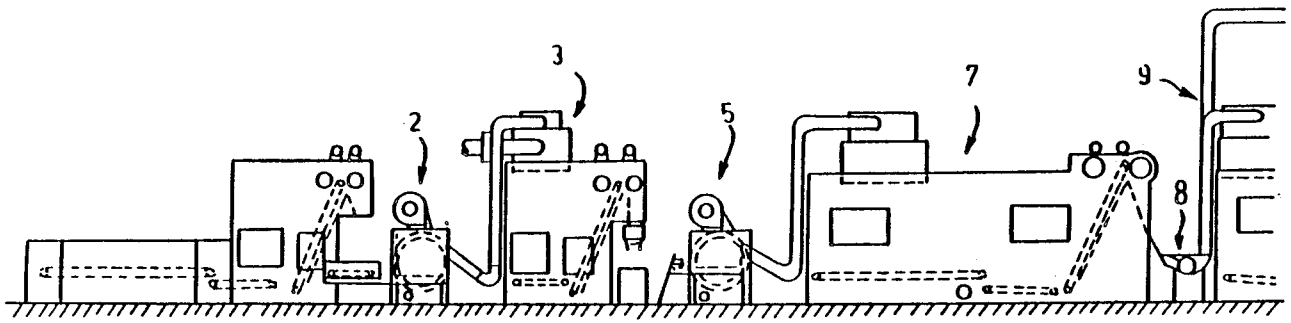
FIG. 1 is a side view of the first half of a production line, FIG. 1*a* being a top view thereof.

Waste fibers and bonding fibers used as raw material for the nonwoven fabric to be produced are brought to the place in bales. The fibers of the bales are moved manually on conveyor belts (1–4) of drop feeding devices. Two feeding devices are provided for the waste fibers and for the bonding fibers. The feeding device is provided with a slanting elevator belt (preferably spiked), wherefrom a levelling roll takes the fibers. The fibers thereafter fall evenly on a conveyor belt leading to a tearing machine 2. The fibers are quickly blown from a tearing drum rotating at a high rate into a cyclone, wherein dust is removed by aspiration through a sheet provided with holes.

From the cyclone, the waste fibers fall into an intermediate drop feeder 3 and therefrom they are passed into a weighing box.

Also the bonding fibers are passed in a similar manner into a weighing device via a drop feeding device 4.

The fibers are mixed with each other on the basis of a desired weight ratio by dropping them on a common collector conveyor, the movement of which is so adjusted that fibers of a different type fall on each other.

The required card chemicals are sprayed on the fibers in a moistening device. Thereafter a conveyor belt feeds the material on a mixing roll 5, which tears and mixes the fiber bundles and from the surface of which the fibers are removed through aspiration. From the mixing roll, the material is pneumatically transferred into a cyclone, wherefrom the fibers fall into a mixer 7. Dust is removed from the cyclone into a filter unit 6. The mixer is provided with two conveyor belts and an elevator belt. The mixing is carried out in the horizontal direction from the cyclone and in the vertical direction by means of a conveyor belt and an elevator belt. A transfer roll transfers the fiber bundles from the elevator belt to the aspiration side of a fan 8, which passes the fibers into three different cyclones. The cyclone feeds the fibers into a feeding box 9, which comprises an elevator belt and a levelling roll and a transfer roll, through which the material is fed into a feeding trough. The back wall of said trough vibrates at an adjustable frequency, depending on the different velocities of the card.

The card is indicated generally by the reference numeral 10. The fiber mat is passed from said feeding trough between the nips of two pairs of feedings rollers 11 to a first main roll 12. A working roll 13 with a guide roll 14 is positioned on the circumference of said main roll in a known manner. Known cards comprise only one main roll of this type, which roll is remarkably large, a great number of working rolls with guide rolls being positioned along the circumference of said main roll.

An essential feature of the card according to the invention is that, as distinctive from above, three main rolls 12, 17 and 20 are preferably positioned in sequence and that the transferring of the fiber material is carried out through working rolls 15, 16 and 18, 19, which rotate at a lower rate. The roll 17 preferably rotates at a higher rate than the roll 12 and the roll 20 preferably at a higher rate than the roll 17. The working rolls 15, 16 and 18, 19 may rotate at an equal rate. A collector roll 23 is positioned after the third main roll 20 for flatting the fibers; said flatting can as well be carried out in two stages, whereby another collector roll 24 (FIG. 5) is provided after the roll 23.

Figure 3:
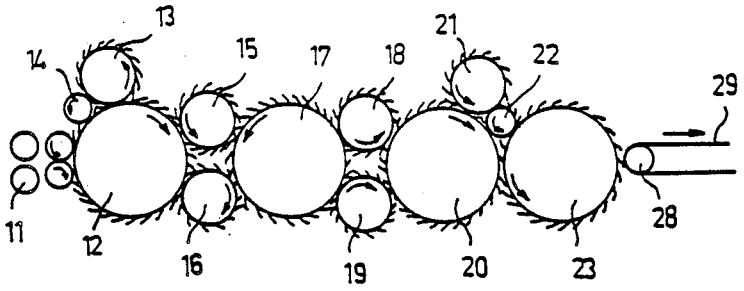
FIGS. 3, 4 and 5 are side views of the three embodiments of the card.
Figure 5:
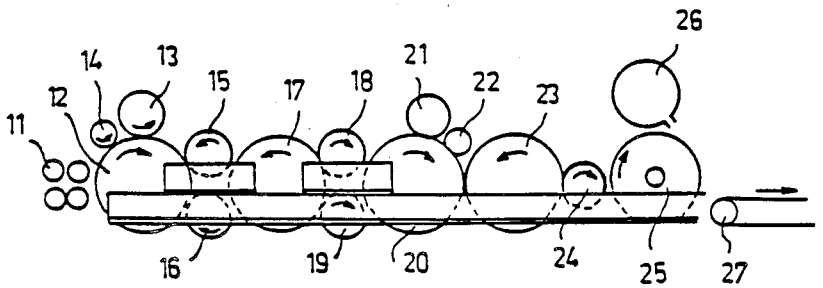

In FIGS. 3 and 5, the second rolls 16 and 18 rotate in the opposite direction with respect to the first transfer rolls 15 and 19. This brings about the advantage that excessive fiber material, if any, is not gathered e.g. in the nip between the rolls 16 and 17, but said material is passed on the roll 16 and is returned to the feed through the main roll 12.

Figure 4:
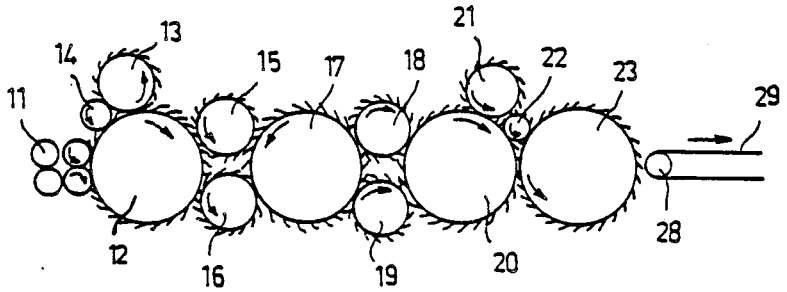

Especially when the fiber material is relatively coarse, the rolls 16 and 19 can also rotate in the same direction as the rolls 15 and 18, FIG. 4, whereby the rolls 15 and 19 can collect the uppermost fibers and the rolls 16 and 18 can take fibers of deeper position. The roll 16 could, of course, rotate in the opposite direction with respect to the roll 15 and the roll 19 in the same direction as the roll 18.

In the card according to FIGS. 3 to 5, the fibers are flatted several times, beginning from the rolls 15 and 16 and each time mainly permanently. The spikes of the main rolls extend in the same direction as the arrows indicating the direction of rotation, the spikes of the working and flatting rolls extending in the opposite direction. The spikes of the main roll 17 are preferably more densely set than those of the main roll 12 and the spikes of the main roll 12 even more densely, and, correspondingly, the circumferential velocities of the rolls can be substantially raised as compared with known cards. It can be mentioned as examples that the circumferential velocities of the main rolls 12, 17, 20 can be approx. 500 m/min, approx. 700 m/min and respectively approx. 1000 m/min. The velocities of the working rolls typically fall in the range of approx. 50 m/min, the velocities of the flatting rolls being adjustable e.g. within the range from approx. 15 to approx. 70 m/min.

Figure 2:
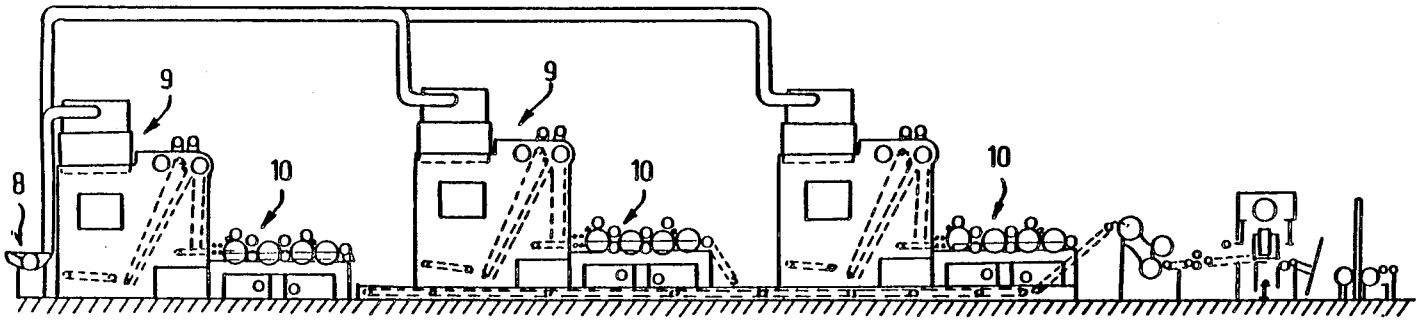
FIG. 2 is a side view of the second half of the production line.
Figure 1A:
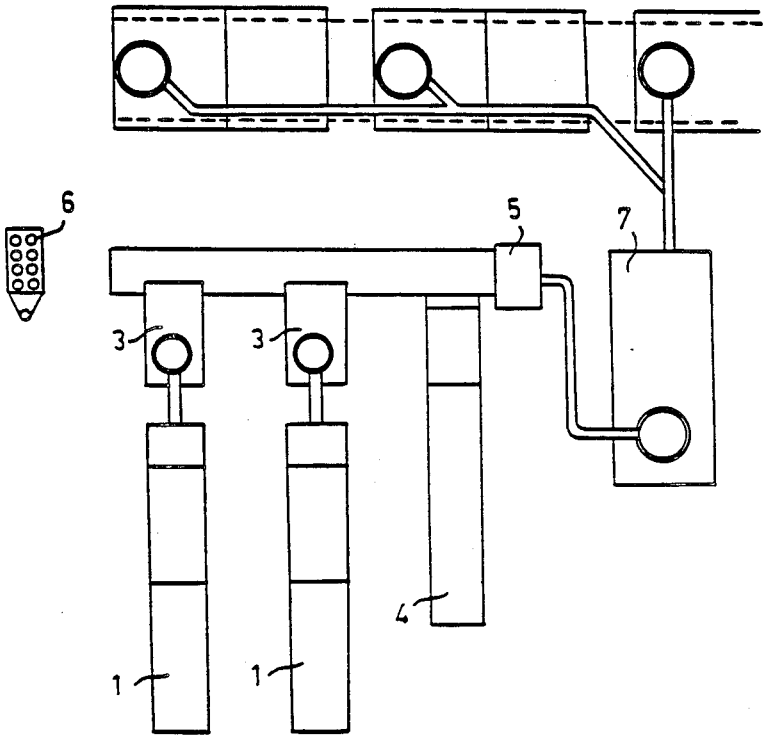

The web can be removed from the last collector roll 23 (or 24) in a known manner by means of a vibrating comb and be passed onto a conveyor belt, as appears from FIG. 2, the production line according to said Figure comprising three cards 10. In such a procedure, it is often advisable to guide the webs together into a three-layer web in order to provide a desired density and strength.

An improvement in the end portion of the card is shown in FIGS. 3 and 4. An aspiration roller 28 is positioned after the collector or flatting roll 23, a porous conveyor wire 29 extending around said roller. The fiber material is passed as a continuous even web from the roll 23 to the wire 29, which passes the fiber material web to a further treatment known per se. In order to provide an efficient aspiration, the aspiration roller 28 is preferably of the so called honey comb type, whereby the aspiration channels issueing on the surface of the roller can cover approx. 80 per cent of the mantle surface of the rollers.

An alternative solution for the outlet end of the card is outlined in FIG. 5. A roll 25 rotating at a high rate takes the fibers from the flatting roll 24 and passes them in front of a fan 26, which blows them directly on a conveyor, the head portion of which is indicated by the reference numeral 27. In this way, each card 10 produces a fiber web of sufficient density for various purposes, the fibers of which web are oriented essentially evenly in all directions and the strength properties of which, correspondingly, are good.

The driving motors of the rolls and the devices for the feeding and transporting of the fiber web are all preferably direct-current motors, whereby the total rate of the production line can be continuously adjusted. When the manufacture must be stopped for a short time, only the main rolls 12, 17 and 20 are left rotating. It is thus a very essential feature of the card according to the invention that the main rolls 12, 17 and 20 are not gradually emptied, as has been the case in the known cards, so stopping of the manufacture does not cause any break in the web nor has it any influence on the quality of the web to the produced, the web being maintained even immediately after re-starting.

The afore-described embodiment of the invention, comprising three main rolls, is regarded as advantageous, but also the use of only two or more rolls belongs to the scope of the invention. The working roll 21 with the guide roll 22 can be left out or, alternatively, such a roll can be positioned in connection with the roll 17. The stages for the thermal treatment and calendering of the fiber web after the card are per se known; they are therefore not described more closely here.

We claim:

1. A carding device useful in the production of non-woven fabrics, comprising:

a plurality of rotatable main rolls arranged in sequence for forming a fiber web having fibers oriented evenly in all directions, wherein each succeeding main roll in the sequence rotates at a rate higher than the preceding main roll;

a feed means for passing fibers to said plurality of main rolls;

said main rolls being positioned with respect to each other so that the fiber web is transferred therebetween by said transfer rolls only;

a first rotatable flatting roll disposed after the last main roll in the sequence; and means for transferring the web to further treatment disposed after flatting roll; and wherein the improvement comprises:

a pair of transfer rolls rotatable at a lower rate than said main rolls disposed between adjacent main rolls for working and transferring the web from one main roll to another, wherein the transfer rolls in each pair rotate in opposite directions for transferring excess fiber to the preceding main roll.

2. A carding device useful in the production of non-woven fabrics, comprising:

a plurality of rotatable main rolls arranged in sequence for forming a fiber web having fibers oriented evenly in all directions, wherein each succeeding main roll in the sequence rotates at a rate higher than the preceding main roll;

a feed means for passing fibers to said plurality of main rolls;

said main rolls being positioned with respect to each other so that the fiber web is transferred therebetween by said transfer rolls only;

a first rotatable flatting roll disposed after the last main roll in the sequence;

means for transferring the web to further treatment disposed after flatting roll; and wherein the improvement comprises:

a pair of transfer rolls rotatable at a lower rate than said main rolls disposed between adjacent main rolls for working and transferring the web from one main roll to another, wherein the transfer rolls in each pair rotate in the same direction so that one of the transfer rolls takes fibers from a deeper position in the web than those taken by the other transfer roll in the pair.

* * * * *